US011311893B2

(12) United States Patent
Malert et al.

(10) Patent No.: US 11,311,893 B2
(45) Date of Patent: Apr. 26, 2022

(54) JET FORMER, IN PARTICULAR FOR A SANITARY SHOWER HEAD, COMPRISING A ROTOR BLADE THAT IS CONFIGURED AND DESIGNED TO DIVIDE A FLOW OF WATER INTO PARTS AND PARTIAL FLOWS

(71) Applicant: Grohe AG, Hemer (DE)

(72) Inventors: Nicolai Malert, Froendenberg (DE); Mike Ruthmann, Iserlohn (DE); Niklas Hoefte, Hemer (DE); Torsten Meier, Neuss (DE)

(73) Assignee: Grohe AG, Hemer (DE)

( * ) Notice: Subject to any disclaimer, the term of this patent is extended or adjusted under 35 U.S.C. 154(b) by 128 days.

(21) Appl. No.: 16/592,609

(22) Filed: Oct. 3, 2019

(65) Prior Publication Data

US 2020/0030827 A1 Jan. 30, 2020

Related U.S. Application Data

(63) Continuation of application No. PCT/EP2018/058167, filed on Mar. 29, 2018.

(30) Foreign Application Priority Data

Apr. 3, 2017 (DE) ..... 10 2017 107 115.6

(51) Int. Cl.
*B05B 1/18* (2006.01)
*B05B 3/04* (2006.01)

(52) U.S. Cl.
CPC ..... *B05B 1/18* (2013.01); *B05B 3/0422* (2013.01)

(58) Field of Classification Search
CPC ..... B05B 1/18; B05B 1/185; B05B 3/0418; B05B 3/0422; B05B 3/0459; B05B 3/16; B05B 3/08; B05B 3/1035
See application file for complete search history.

(56) References Cited

U.S. PATENT DOCUMENTS

| | | | |
|---|---|---|---|
| 233,692 | A | 10/1880 | Pelton |
| 1,412,257 | A | 4/1922 | Petsche |
| 1,819,098 | A | 8/1931 | Howard |
| 3,584,790 | A | 6/1971 | Bonfield |
| 4,746,808 | A | 5/1988 | Kaeser |

(Continued)

FOREIGN PATENT DOCUMENTS

AT 405 795 B 4/1999

*Primary Examiner* — Darren W Gorman
(74) *Attorney, Agent, or Firm* — Muncy, Geissler, Olds & Lowe, P.C.

(57) ABSTRACT

A jet former, including an impeller wheel rotatably mounted about an axis of rotation, having a blade arrangement, a control device, and at least one movably mounted nozzle. The control device is arranged and constructed to convert a rotation of the axis of rotation into a movement of the at least one nozzle. At least one blade of the blade arrangement is arranged and formed to divide the water flow directed towards the at least one blade in a direction of flow into at least a first partial flow and a further partial flow, to deviate the first partial flow in a first partial flow direction, and to deviate the other partial flow in a further partial flow direction. The direction of flow, the first partial flow direction and the further partial flow direction in each case differ from each other.

8 Claims, 7 Drawing Sheets

(56) References Cited

U.S. PATENT DOCUMENTS

| | | | | |
|---|---|---|---|---|
| 6,908,047 | B2 * | 6/2005 | Saunders | B05B 3/16<br>239/225.1 |
| 2009/0101734 | A1 | 4/2009 | Tsai | |

* cited by examiner

JET FORMER, IN PARTICULAR FOR A SANITARY SHOWER HEAD, COMPRISING A ROTOR BLADE THAT IS CONFIGURED AND DESIGNED TO DIVIDE A FLOW OF WATER INTO PARTS AND PARTIAL FLOWS

This nonprovisional application is a continuation of International Application No. PCT/EP2018/058167, which was filed on Mar. 28, 2018, and which claims priority to German Patent Application No. 10 2017 107 115.6, which was filed in Germany on Apr. 3, 2017, and which are both herein incorporated by reference.

BACKGROUND OF THE INVENTION

Field of the Invention

The present invention relates to a jet former, including an impeller wheel rotatably mounted about a shaft that forms an axis of rotation, having a blade arrangement, a control device, and at least one movably mounted nozzle. The control device can be arranged and constructed to convert a rotation of the shaft into a movement of the at least one nozzle. At least one blade of the blade arrangement can be arranged and formed to: divide the water flow directed towards the at least one blade in the direction of flow into at least one first partial flow and a further partial flow, deviate the first partial flow in a first partial flow direction, and deviate the further partial flow in a further partial flow direction. The direction of flow, the first partial flow direction and the further partial flow direction in each case can differ from each other. Further, the invention relates to a shower head, including the jet former; an impeller wheel, in particular for a jet former; a production method for an impeller wheel; an impeller wheel, obtainable according to this method; the use of one of the aforementioned impeller wheels in a jet former; and a device and a shower, each including the above shower head.

Description of the Background Art

A common type of body cleansing is showering. Generally, shower devices are used for showering, which include a mixer tap, a water conducting hose or a water conducting pipe, and a sanitary shower head. In the mixer tap, cold and hot water are mixed to a desired water temperature. The water is guided in the water conducting hose or in the water conducting pipe to the shower head, which discharges the water. The design of the water output through the shower head in the form of a jet pattern substantially determines the showering experience of the user. To generate the jet pattern, the shower head includes an assembly, which is referred to as a jet former. In the prior art, shower heads are known which can provide a moving jet pattern. Such shower heads are also referred to as massage shower heads, since the moving water jets can achieve a massage effect. For this purpose, jet forming nozzles of the jet former perform a periodic movement, for example a pivoting or rotating. In order to drive this movement of the jet forming nozzles, the jet former usually includes an impeller wheel, which in turn is driven by the water flowing into the shower head.

The above-described massage shower heads of the prior art have the following disadvantages. To drive the impeller wheel and thus initiate the massage function, a relatively high water pressure or a relatively high volume flow of water or both are necessary. This results in a relatively high consumption of water for operating massage shower heads of the prior art.

Further, massage shower heads of the prior art may experience a delayed start of the massage function. Thus, in a start-up phase after opening the water path into the shower head, it could come to a non-moving jet pattern, which does not allow for the massage function of the shower head to materialize.

SUMMARY OF THE INVENTION

It is therefore an object of the present invention to overcome the a disadvantages arising from the prior art. Another object of the invention is to provide a shower head which generates a moving jet pattern at the lowest possible water consumption. Furthermore, it is an object of the invention to provide a shower head that generates a moving jet pattern at the lowest possible water pressure. Another object of the invention is to provide a shower head that generates a moving jet pattern with the shortest possible start-up phase. Another object of the invention is to provide a shower head, which produces a jet pattern moving as fast as possible at a constant water pressure and with a constant water consumption. A further object of the invention is to provide a shower head that can produce several different moving jet patterns at a constant water pressure and with a constant water consumption. Another object of the invention is to provide one of the abovementioned advantageous shower heads, wherein when operating the shower head, the moving jet pattern can be maintained with the water pressure of a domestic drinking water pipeline. Further, it is an object of the invention to provide a shower head with a combination of at least two of the aforementioned advantages. Further, it is an object of the invention to provide a sanitary shower having one of the above advantageous shower heads. Another object of the invention is to provide an impeller wheel for one of the abovementioned advantageous shower heads, wherein an impeller wheel of the shower head can be produced as simply or cost-effectively as possible, or both, preferably made up of as few individual components as possible, most preferably in an injection molding process. Furthermore, it is an object of the invention to provide a production method for the aforementioned impeller wheel.

In an exemplary embodiment, a jet former is provided, including an impeller wheel rotatably mounted about a shaft that forms an axis of rotation, having a blade arrangement, a control device, and at least one movably mounted nozzle. The control device can be arranged and constructed to convert a rotation of the shaft into a movement of the at least one nozzle. At least one blade of the blade arrangement can be arranged and formed to, divide a water flow directed towards the at least one blade in a direction of flow into at least a first partial flow and a further partial flow, deviate the first partial flow in a first partial flow direction, and deviate the other partial flow in a further partial flow direction;

The direction of flow, the first partial flow direction and the further partial flow direction in each can case can differ from each other. A preferred jet former is a jet former for a shower head or a washing brush, or both. Here, a jet former for a shower head, preferably a sanitary shower head, is particularly preferred. A preferred shower head is a massage shower head. The blade arrangement preferably includes a plurality of blades of the impeller wheel. In this case, a jet former is preferably a device for a fixture for dispensing water in a jet pattern, wherein the jet former is the assembly of the device, whose components produce the jet pattern. For forming the jet pattern, the jet former can include a plurality of jet forming nozzles. If the aforementioned device is a shower head, the jet forming nozzles preferably include a spray base, which further contains the jet former. A preferred jet former is designed to generate at least one dynamic jet pattern. A preferred dynamic jet pattern changes periodically over time during operation. Here, the shape of the jet pattern may change periodically, or the jet direction of the jet pattern, or both.

The jet former can be configured such that the at least one blade contains a blade bottom surface, and a flow divider.

The flow divider can be arranged and formed to divide the water flow directed towards the at least one blade in the direction of flow into at least the first partial flow and the further partial flow. A preferred flow divider is a blade. A preferred blade is a center blade. A center blade is known from a blade of a Pelton turbine. The Pelton turbine usually has shell-shaped curved blades. In contrast thereto, the blade bottom surface of the jet former according to the invention is preferably curved in a cross sectional plane perpendicular to the axis of rotation, but not in cross sectional planes through the blade bottom surface that are in parallel with the axis of rotation.

The jet former can also be configured such that the at least one blade of the blade arrangement is arranged and constructed to deviate the first partial flow by a first deflection angle in a range of 45 to 180°, preferably from 60 to 180°, more preferably from 70 to 180°, more preferably from 80 to 180°, more preferably from 85 to 180°, more preferably from 85 to 170°, more preferably from 85 to 160°, more preferably from 85 to 150°, more preferably from 85 to 140°, more preferably from 85 to 130°, more preferably from 85 to 120°, more preferably from 85 to 110°, more preferably from 85 to 100°, most preferably from 85 to 95°, in the first partial flow direction, or deviate the further partial flow by a further deflection angle in a range of 45 to 180°, preferably from 60 to 180°, more preferably from 70 to 180°, more preferably from 80 to 180°, more preferably from 85 to 180°, more preferably from 85 to 170°, more preferably from 85 to 160°, more preferably from 85 to 150°, more preferably from 85 to 140°, more preferably from 85 to 130°, more preferably from 85 to 120°, more preferably from 85 to 110°, more preferably from 85 to 100°, most preferably from 85 to 95°, in the further partial flow direction, or both.

The jet former can be configured such that the impeller wheel can be arranged and designed such that the direction of flow is at an angle to the axis of rotation in the range of 45 to 135°, preferably from 60 to 120°, more preferably from 70 to 110°, more preferably from 80 to 100°, most preferably from 85 to 95°. Preferably, the direction of flow is oriented tangentially to the impeller wheel.

The jet former can be configured such that the flow divider can be formed as a divider wall arranged on the blade bottom surface.

The jet former can be configured such that the divider wall tapers in the direction from the blade bottom surface to an edge of the divider wall.

The jet former can be configured such that a cross section of the blade bottom surface is curved in a cross sectional plane through the blade bottom surface perpendicular to the axis of rotation. Preferably, the cross section of the blade bottom surface in the cross sectional plane through the blade bottom surface perpendicular to the axis of rotation curves away from the axis of rotation.

The jet former can be configured such that a cross section of the blade bottom surface is not curved in a cross sectional plane through the blade bottom surface in parallel with the axis of rotation. Preferably, the cross section of the blade bottom surface in the cross sectional plane through the blade bottom surface in parallel with the axis of rotation is a straight line.

The jet former can be configured such that the jet former further comprises a reduction gear, wherein the reduction gear is connected to the shaft on the drive side to transmit power, and is connected to the control device on the output side to transmit power.

The jet former can be configured such that the reduction gear is an epicyclic gear train. An epicyclic gear train can also be referred to as planetary gear.

The jet former can be configured such that the control device comprises a cam disc. An exemplary control device can be a cam gear.

The jet former can be configured such that the jet former further comprises at least one intake nozzle, wherein the intake nozzle is arranged and designed for the water flow to be directed towards the impeller wheel in the direction of flow.

The jet former can be configured such that the intake nozzle includes a nozzle opening, wherein the nozzle opening has an opening area in a range of 0.5 to 100 $mm^2$, preferably from 0.5 to 50 $mm^2$, more preferably from 0.5 to 20 $mm^2$, more preferably from 1 to 10 $mm^2$, most preferably from 1 to 5 $mm^2$.

The jet former can be configured such that the impeller wheel is made of plastic.

The jet former can be configured such that the impeller wheel is formed in one piece.

The jet former can be configured such that the impeller wheel has a diameter in a range from 10 to 200 mm, preferably from 15 to 150 mm, more preferably from 20 to 100 mm, further preferably from 25 to 75 mm or from 30 to 50 mm.

Also provided is a shower head with a housing, wherein said housing contains the jet former. An exemplary shower head can be a shower head for a hand-held shower head or an overhead shower head or both. Another preferred shower head is a massage shower head.

The shower head can be configured such that the housing includes at least one intake nozzle, wherein the intake nozzle is arranged and configured to direct the water flow towards the impeller wheel in the direction of flow.

The shower head can be configured such that the intake nozzle includes a nozzle opening, wherein the nozzle opening has an opening area in a range of 0.5 to 100 $mm^2$, preferably from 0.5 to 50 $mm^2$, more preferably from 0.5 to 20 $mm^2$, more preferably from 1 to 10 $mm^2$, most preferably from 1 to 5 $mm^2$.

Also provided is an impeller wheel with a blade arrangement, wherein said impeller wheel is rotatably mountable about a shaft that forms an axis of rotation; wherein at least one blade of the blade arrangement contains a blade bottom surface, and a flow divider.

The flow divider is arranged and configured to divide a water flow directed towards the at least one blade in a direction of flow into at least a first partial flow and a further partial flow; wherein the at least one blade is further arranged and configured to deviate the first partial flow in a first partial flow direction, and deviate the further partial flow in a further partial flow direction.

The direction of flow, the first partial flow direction and the further partial flow direction in each case differ from each other; wherein a cross section of the blade bottom surface in a cross sectional plane through the blade bottom surface in parallel with the axis of rotation is not curved. A preferred impeller wheel is an impeller wheel for a jet former. A preferred jet former is a jet former for a shower head or a washing brush, or both. Here, a jet former for a shower head is particularly preferred. A preferred shower head is a massage shower head. The blade arrangement preferably includes a plurality of blades of the impeller wheel.

The impeller wheel can be configured such that a cross section of the blade bottom surface in a cross sectional plane through the blade bottom surface perpendicular to the axis of rotation is curved.

The impeller wheel can be configured such that the at least one blade of the blade arrangement is arranged and configured to deviate the first partial flow by a first deflection angle in a range of 45 to 180°, preferably from 60 to 180°, more preferably from 70 to 180°, more preferably from 80 to 180°, more preferably from 85 to 180°, more preferably from 85 to 170°, more preferably from 85 to 160°, more preferably from 85 to 150°, more preferably from 85 to 140°, more preferably from 85 to 130°, more preferably from 85 to 120°, more preferably from 85 to 110°, more preferably from 85 to 100°, most preferably from of 85 to 95°, in the first partial flow direction, or deviate the further partial flow by a further deflection angle in a range of 45 to 180°, preferably from 60 to 180°, more preferably from 70 to 180°, more preferably from 80 to 180°, more preferably from 85 to 180°, more preferably from 85 to 170°, more preferably from 85 to 160°, more preferably from 85 to 150°, more preferably from 85 to 140°, more preferably from 85 to 130°, more preferably from 85 to 120°, more preferably from 85 to 110°, more preferably from 85 to 100°, most preferably from 85 to 95°, in the further partial flow direction, or both.

The impeller wheel can be configured such that the direction of flow is at an angle to the axis of rotation in a range of 45 to 135°, preferably from 60 to 120°, more preferably from 70 to 110°, more preferably from 80 to 100°, most preferably from 85 to 95°.

The impeller wheel can be configured such that the flow divider is formed as a divider wall arranged on the blade bottom surface.

The impeller wheel can be configured such that the divider wall tapers in the direction from the blade bottom surface to an edge of the divider wall.

The impeller wheel can be configured such that the impeller wheel is made of plastic.

The impeller wheel can be configured such that the impeller wheel is integrally formed.

The impeller wheel can be configured such that the impeller wheel has a diameter in a range of 10 to 200 mm, preferably from 15 to 150 mm, more preferably from 20 to 100 mm, further preferably from 25 to 75 mm or from 30 to 50 mm.

Also provided is a method, comprising the following process steps: providing a starting material, plasticizing the starting material; introducing the plasticized starting material into a negative mold of a blade; solidifying the plasticized starting material; and demolding the solidified starting material to obtain the impeller wheel.

The impeller wheel can be rotatably mounted about a shaft that forms an axis of rotation; wherein at least one blade of a blade arrangement of the impeller wheel contains a blade bottom surface, and a flow divider.

The flow divider can be arranged and configured to divide the water flow directed towards the at least one blade in a direction of flow into at least a first partial flow and a further partial flow; wherein the at least one blade is further arranged and configured to deviate the first partial flow in a first partial flow direction, and deviate the further partial flow in a further partial flow direction.

The direction of flow, the first partial flow direction and the further partial flow direction in each case differ from each other. Preferably, the method is a method of injection molding the impeller wheel.

The method can be configured such that a cross section of the blade bottom surface in a cross sectional plane through the blade bottom surface parallel to the axis of rotation is not curved.

The method can be configured such that the starting material contains plastic, or is a plastic.

The negative mold can contain at least two mold parts, wherein the demolding in the process step e) includes separating the at least two mold parts.

A cross section of the blade bottom surface in a cross sectional plane through the blade bottom surface perpendicular to the axis of rotation can be curved.

The at least one blade of the blade arrangement is arranged and configured to deviate the first partial flow by a first deflection angle in a range of 45 to 180°, preferably from 60 to 180°, more preferably from 70 to 180°, more preferably from 80 to 180°, more preferably from 85 to 180°, more preferably from 85 to 170°, more preferably from 85 to 160°, more preferably from 85 to 150°, more preferably from 85 to 140°, more preferably from 85 to 130°, more preferably from 85 to 120°, more preferably from 85 to 110°, more preferably from 85 to 100°, most preferably from 85 to 95°, in the first partial flow direction, or deviate the further partial flow by a further deflection angle in a range of 45 to 180°, preferably from 60 to 180°, more preferably from 70 to 180°, more preferably from 80 to 180°, more preferably from 85 to 180°, more preferably from 85 to 170°, more preferably from 85 to 160°, more preferably from 85 to 150°, more preferably from 85 to 140°, more preferably from 85 to 130°, more preferably from 85 to 120°, more preferably from 85 to 110°, more preferably from 85 to 100°, most preferably from 85 to 95°, in the further partial flow direction, or both.

The method can be configured such that the direction of flow is at an angle to the axis of rotation in the range of 45 to 135°, preferably from 60 to 120°, more preferably from 70 to 110°, more preferably from 80 to 100°, most preferably from 85 to 95°.

The method can be configured such that the flow divider is designed as a divider wall arranged on the blade bottom surface.

The method can be configured such that the divider wall tapers in the direction from the blade bottom surface to an edge of the divider wall.

The method can be configured such that impeller wheel has a diameter in a range of 10 to 200 mm, preferably from 15 to 150 mm, more preferably from 20 to 100 mm, more preferably from 25 to 75 mm or from 30 to 50 mm.

The impeller wheel can be used in a jet former.

The jet former can contain a shower head.

The shower head can be connected in a water conducting manner with a mixing device for mixing water of at least two different temperatures. In a preferred device, the shower head is connected in a water conducting manner via a water supply to the mixing device. A preferred water supply is formed rigid or flexible or both. A preferred rigid water supply is a water pipe. A preferred flexible water supply is a hose. A preferred hose is a shower hose. A preferred mixing device is a mixer tap. Another preferred mixing device includes an item selected from the group consisting of a fixture, a faucet, a valve, a thermostat, a rotary handle, a hand wheel, a single-lever mixer or a combination of at least two thereof.

A preferred shower is a sanitary shower, which is also called a shower. Here, the shower is preferably a device which enables artificial irrigation of the body with cold or hot water for personal hygiene. In this case, the water is dispensed from the shower head. A preferred shower is a shower for people. Another preferred shower includes a splash protection. A preferred splash protection is one selected from the group consisting of a shower curtain, a shower roller blind, a door, a snail shower, a spiral shower or a combination of at least two thereof. A preferred door is a sliding door or a hinged door or both. Another preferred door includes glass or plastic glass, such as acrylic glass, or both. Another preferred shower is a shower including a shower tray, or a walk-in shower or both.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
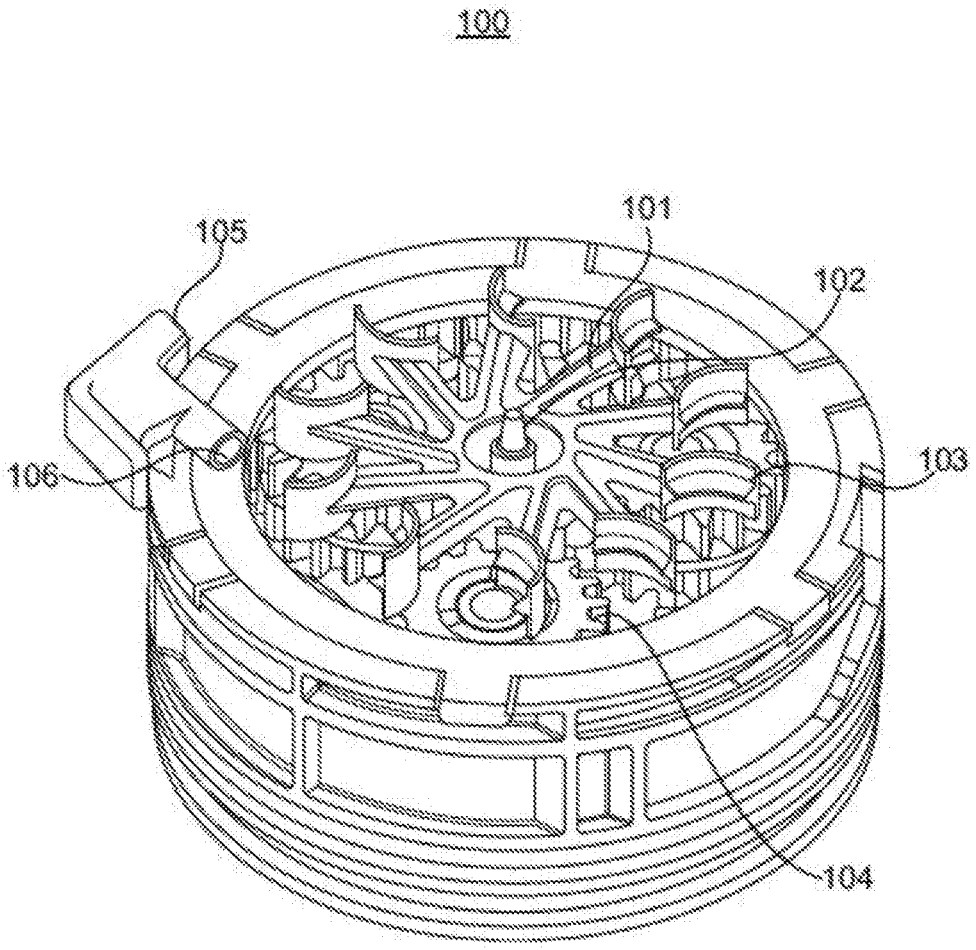
FIG. 1 is a schematic representation of a jet former according to the invention.

FIG. 1 shows a schematic representation of a jet former 100 of the present invention. The jet former 100 is an assembly for a sanitary shower head 400. The jet former 100 includes an impeller wheel 101 rotatably mounted about a shaft 102 that forms an axis of rotation 102*a*, having a blade arrangement; a reduction gear 104, which is a planetary gear; a control device; and a plurality of movably arranged jet forming nozzles. The control device is a cam gear, which includes a cam disc. The reduction gear 104 is connected to the shaft 102 on the drive side and to the control device on the output side to transmit power. The control device is arranged and configured to convert the rotation of the shaft 102 transmitted through the reduction gear 104 into a periodic movement of the plurality of movably arranged jet forming nozzles. The blade arrangement of the impeller wheel 101 is composed of a plurality of blades 103. The blades 103 are each disposed and configured to divide a water flow 301 directed towards the respective blade 103 in a direction of flow 301 into a first partial flow 302 and a further partial flow 303; to deviate the first partial flow 302 in a first partial flow direction 302; and to deviate the further partial flow 303 in a further partial flow direction 303. Here, the direction of flow 301 is at an angle of 90° to the axis of rotation 102*a*, since the water flow 301 tangentially flows against the impeller wheel 101. The first partial flow direction 302 and the further partial flow direction 303 are each in parallel with the axis of rotation 102*a*. Further, the first partial flow direction 302 and the further partial flow direction 303 are oppositely directed. Thus, the blades 103 are adapted to deviate the first partial flow 302 by a first deflection angle of 90° and the further partial flow 303 by a further deflection angle of 90°. An illustration of the directions can be seen in FIG. 3. The jet former 100 further includes an intake nozzle 105 with a nozzle opening 106. The intake nozzle 105 is arranged and formed for the water flow 301 to be directed towards the impeller wheel 101 in the direction of flow 301.

Figure 2:
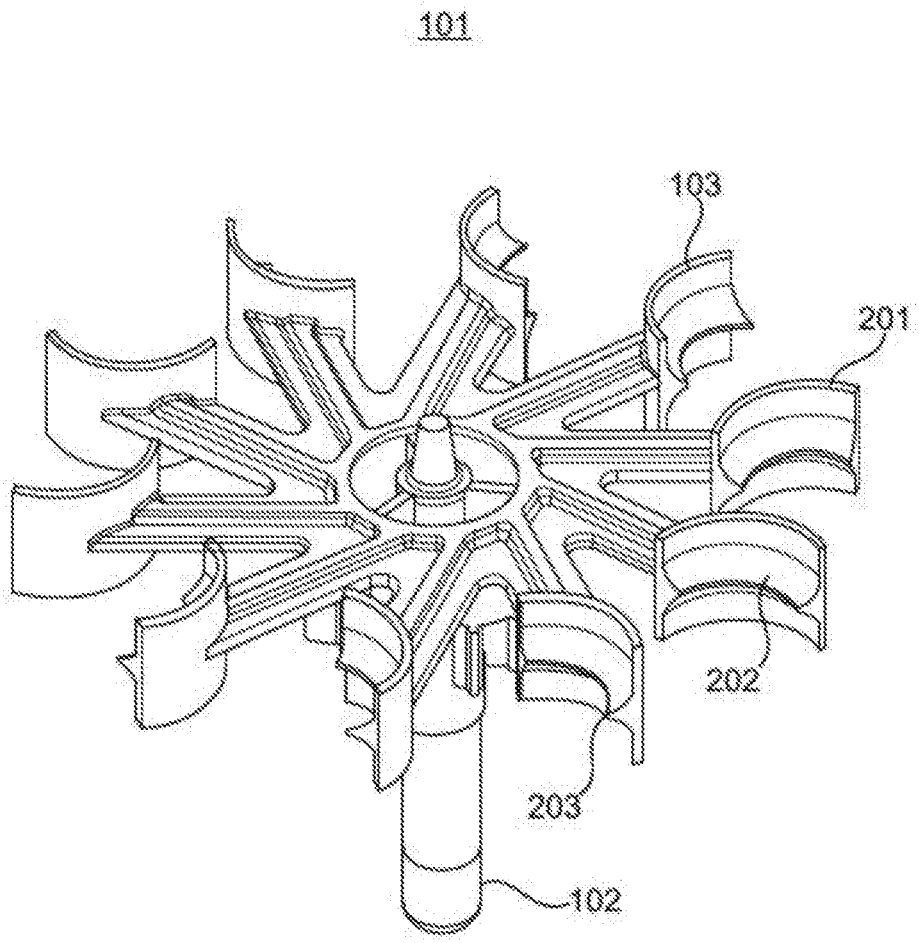
FIG. 2 is a schematic representation of an impeller wheel according to the invention.

FIG. 2 shows a schematic representation of an impeller wheel 101 according to the invention. The impeller wheel 101 of FIG. 2 is the impeller wheel 101 of the jet former 100 of FIG. 1. The impeller wheel 101 is made of plastic and is produced in one piece. Further, the impeller wheel 101 has a diameter of 32 mm. Each of the blades 103 of the impeller wheel 101 includes a blade bottom surface 201 and a flow divider 202. Here, the flow divider 202 is arranged and formed to divide the water flow 301 directed towards the respective blade 103 in the direction of flow 301 into the first partial flow 302 and the further partial flow 303. For this purpose, the flow divider 202 is designed as a divider wall arranged on the blade bottom surface 201. This divider wall tapers in the direction from the blade bottom surface 201 to an edge 203 of the divider wall. The divider wall is centered on the blade bottom surface 201 and can also be referred to as the center blade. A cross section of the blade bottom surface 201 of each blade 103 in a cross sectional plane through the blade bottom surface 201 perpendicular to the axis of rotation 102*a* is curved. Here, the cross section of the blade bottom surface 201 in the cross sectional plane through the blade bottom surface 201 perpendicular to the axis of rotation 102*a* is curved away from the axis of rotation 102*a*. Further, each cross section of the blade bottom surface 201 in each cross sectional plane through the blade bottom surface 201 in parallel with the axis of rotation 102*a* is a straight line.

Figure 3:
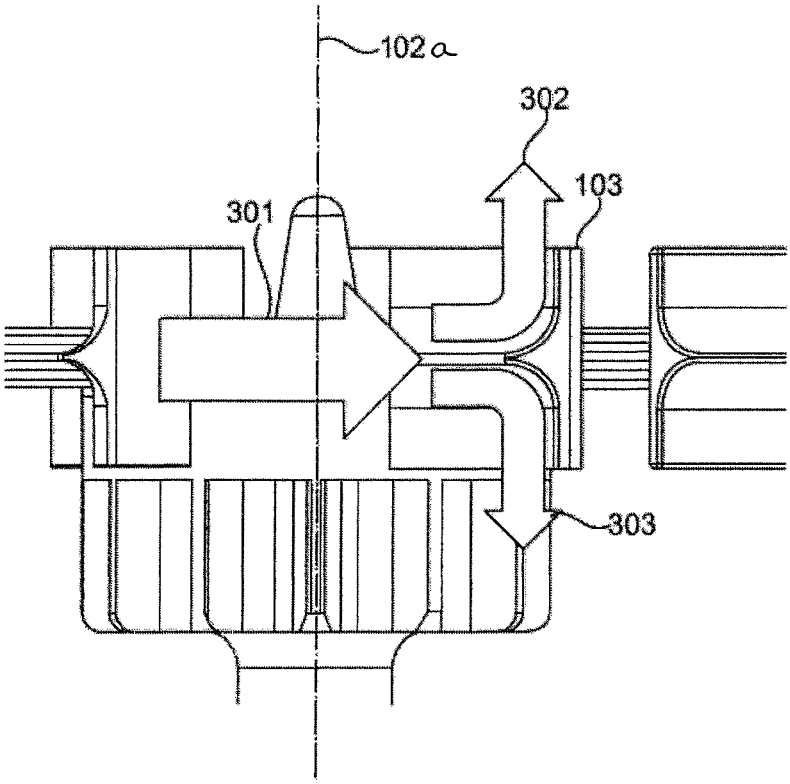
FIG. 3 is a schematic representation of a water flow against a blade of the inventive impeller wheel of FIG. 2.

FIG. 3 shows a schematic representation of a blade 103 of the inventive impeller wheel 101 of FIG. 2 receiving an inflow of water. Here it can be seen how the water flow 301 is direct towards a blade 103 in the direction of flow 301. The flow divider 202 divides the water flow 301 into the first partial flow 302 and the further partial flow 303. The first partial flow 302 is deviated by 90° in the first partial flow direction 302 by means of the flow divider 202 and the blade bottom surface 201. The further partial flow 303 is deviated by 90° into the further partial flow direction 303 by means of the flow divider 202 and the blade bottom surface 201. In this case, the first partial flow direction 302 and the further partial flow direction 303 are in parallel with the axis of rotation 102*a* of the impeller wheel 101 and perpendicular to a plane of the impeller wheel 101. The direction of flow 301 is perpendicular to the axis of rotation 102*a* and lies in the plane of the impeller wheel 101.

Figure 4:
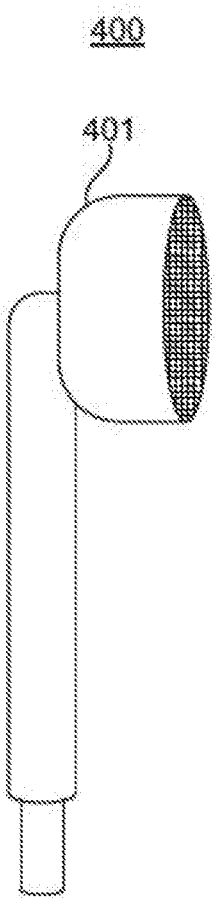
FIG. 4 is a schematic representation of a shower head according to the invention.

FIG. 4 shows a schematic representation of a shower head 400 according to the invention. The shower head 400 is a sanitary shower head 400, in this case a massage shower head designed as a hand-held shower head, which includes a housing 401. The housing 401 contains the jet former 100 of FIG. 1.

Figure 5:
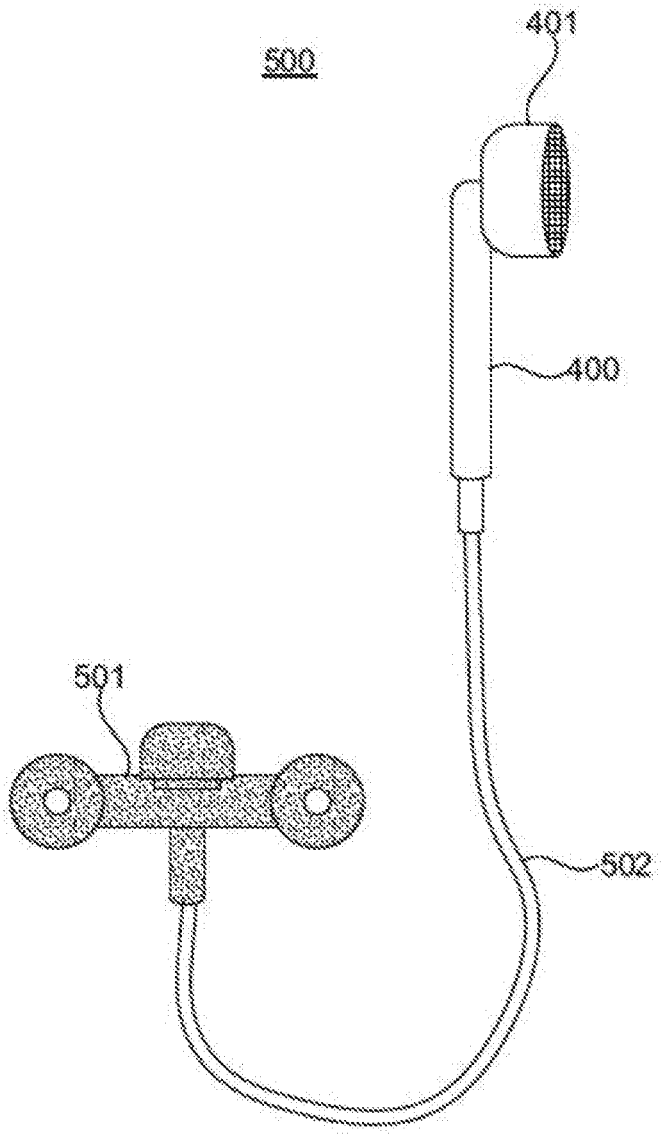
FIG. 5 is a schematic representation of a device according to the invention.

FIG. 5 shows a schematic representation of an inventive device 500. The device 500 contains the shower head 400 of FIG. 4. The shower head 400 is connected in a water-conducting manner via a flexible shower hose 502 to a mixing device 501 for the purpose of mixing water of at least two different temperatures. The mixing device 501 is a sanitary mixer tap.

Figure 6:
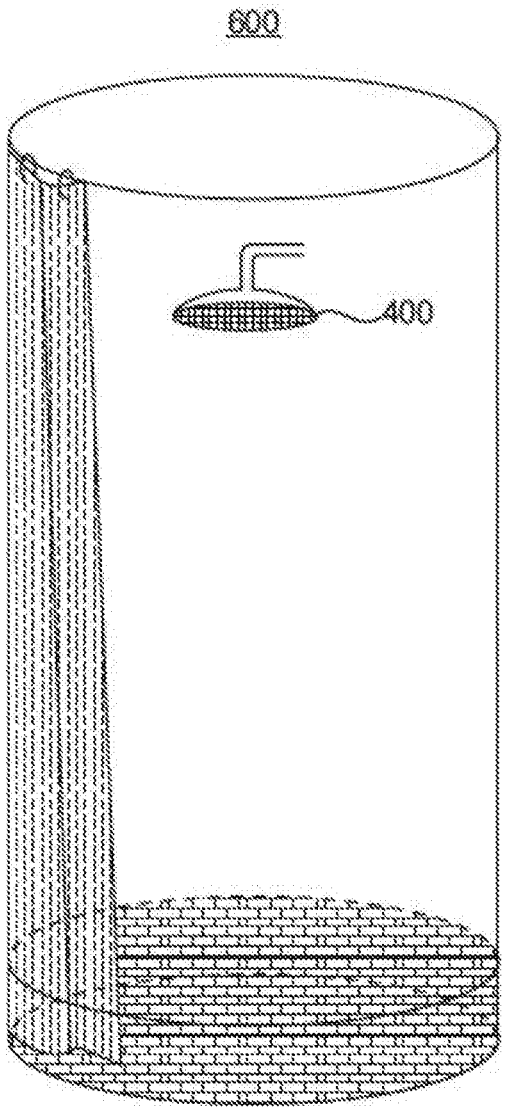
FIG. 6 is schematic representation of a sanitary shower according to the invention.

FIG. 6 shows a schematic representation of a sanitary shower 600 according to the invention. The sanitary shower 600 includes a shower head 400 formed as an overhead shower head. The shower head 400 includes the jet former 100 as shown in FIG. 1.

Figure 7:
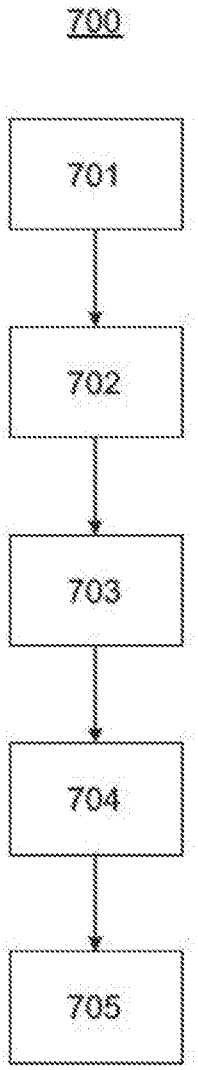
FIG. 7 is a flow chart of a method according to the invention.

FIG. 7 shows a flow chart of a method 700 according to the invention. The method 700 is a method 700 for injection molding of the impeller wheel 101 of FIG. 2. For this purpose, the method 700 includes a process step a) 701: the provision of a starting material, in this case a plastic granulate. In a process step b) 702, the plastic granules are melted in an injection molding machine, i.e., plasticized. In one process step c) 703, the melted plastic is injected under pressure into an injection molding tool. The injection molding tool in this case includes a two-part negative mold of the impeller wheel 101 of FIG. 2, into which the melted plastic is injected. In a process step d) 704, the plastic is cooled and solidified. In a process step e) 705, the two-part negative mold is opened by separating the parts and the solidified plastic is removed from the mold. The impeller wheel 101 of FIG. 2 is obtained.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A shower head comprising:

a shower head housing; and a jet former accommodated in the shower head housing, the jet former comprising:

an impeller wheel rotatably mounted about a shaft that forms an axis of rotation, the impeller wheel having a blade arrangement, wherein at least one blade of the blade arrangement is arranged and configured to:

divide a water flow directed towards the at least one blade in a direction of flow into at least a first partial flow and a further partial flow;

deviate the first partial flow in a first partial flow direction; and deviate the further partial flow in a further partial flow direction, wherein the direction of flow, the first partial flow direction, and the further partial flow direction differ from one another, wherein a front face of the shower head housing, through which the water flow exits the shower head, remains stationary with respect to the impeller wheel, such that the impeller wheel rotates relative to the front face of the shower head housing.

2. The shower head according to claim 1, wherein the at least one blade comprises:

a blade bottom surface; and a flow divider, wherein the flow divider is arranged and formed to divide the water flow directed towards the at least one blade in the direction of flow into the first partial flow and the further partial flow.

3. The shower head according to claim 2, wherein a cross section of the blade bottom surface in a cross sectional plane through the blade bottom surface in parallel with the axis of rotation is not curved.

4. The shower head according to claim 2, wherein a cross section of the flow divider, in a cross sectional plane through the flow divider perpendicular with the axis of rotation, is curved.

5. The shower head according to claim 1, wherein the at least one blade of the blade arrangement is arranged and formed to;

deviate the first partial flow by a first deflection angle in a range of 45 to 180° in the first partial flow direction; or deviate the further partial flow by a further deflection angle in a range of 45 to 180° in the further partial flow direction; or both.

6. The shower head according to claim 1, wherein the housing includes at least one intake nozzle, wherein the at least one intake nozzle is arranged and adapted for the water flow to be directed towards the impeller wheel in the direction of flow.

7. A device comprising the shower head according to claim 1, wherein the shower head is water-conductively connected to a mixing device to mix water of at least two different temperatures.

8. A shower comprising the shower head according to claim 1.

* * * * *